US007834837B2

(12) United States Patent
Syu et al.

(10) Patent No.: US 7,834,837 B2
(45) Date of Patent: Nov. 16, 2010

(54) ACTIVE MATRIX LIQUID CRYSTAL DISPLAY AND DRIVING METHOD THEREOF

(75) Inventors: Yi-Zhong Syu, Miao-Li (TW); Wei-Yu Su, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 858 days.

(21) Appl. No.: 11/645,452

(22) Filed: Dec. 26, 2006

(65) Prior Publication Data

US 2007/0146276 A1 Jun. 28, 2007

(30) Foreign Application Priority Data

Dec. 23, 2005 (TW) ..... 94146368 A

(51) Int. Cl.
*G09G 3/36* (2006.01)

(52) U.S. Cl. ..... 345/92; 349/33

(58) Field of Classification Search ..... 345/87, 345/90, 92, 96; 349/33, 38, 43
See application file for complete search history.

(56) References Cited

U.S. PATENT DOCUMENTS 6,229,510 B1 * 5/2001 Kim et al. ..... 345/87
6,456,268 B1 * 9/2002 Takeda ..... 345/92
6,661,259 B2 12/2003 Tsuchi
6,822,642 B2 11/2004 Chou
6,831,295 B2 12/2004 Tsubo
2005/0122301 A1 * 6/2005 Song ..... 345/96

FOREIGN PATENT DOCUMENTS

TW 505814 C 10/2002

* cited by examiner

*Primary Examiner*—Quan-Zhen Wang
*Assistant Examiner*—Calvin C Ma
(74) *Attorney, Agent, or Firm*—Wei Te Chung

(57) ABSTRACT

An exemplary active matrix LCD (200) includes an LCD panel, a gate driver (211), a data driver (212), and a voltage compensating circuit (240). The LCD panel includes a plurality of gate lines (221) and a plurality of data lines (222) crossing the data lines to define a plurality of pixel units (230). Each pixel unit includes a liquid crystal capacitor (227) and a TFT (223). The liquid crystal capacitor includes a pixel electrode (224) and a common electrode (225). The voltage compensating circuit is configured for detecting a first voltage of a source electrode of one of the TFTs when the TFT turns on, detecting a second voltage of a drain electrode of the TFT when the TFT turns off, and then outputting a compensating voltage according to the first voltage and the second voltage for compensating a kick-back voltage of the TFT.

19 Claims, 5 Drawing Sheets

ACTIVE MATRIX LIQUID CRYSTAL DISPLAY AND DRIVING METHOD THEREOF

FIELD OF THE INVENTION

The present invention relates to an active matrix liquid crystal display (LCD) that has a voltage compensating circuit configured for reducing or eliminating a kick-back voltage that is associated with parasitic capacitance at a thin film transistor of the active matrix LCD, and to an associated method for driving an active matrix LCD.

GENERAL BACKGROUND

An active matrix LCD device has the advantages of portability, low power consumption, and low radiation, and has been widely used in various portable information products such as notebooks, personal digital assistants (PDAs), video cameras and the like. Furthermore, the active matrix LCD device is considered by many to have the potential to completely replace CRT (cathode ray tube) monitors and televisions.

FIG. 8 is a circuit diagram of one pixel unit of a typical active matrix LCD, also showing a gate driver and a data driver of the active matrix LCD. The active matrix LCD 100 includes an LCD panel (not shown), the data driver 112, and the gate driver 111. The LCD panel includes a first substrate (not shown), a second substrate (not shown) arranged in a position facing the first substrate, and a liquid crystal layer (not shown) sandwiched between the first substrate and the second substrate.

The first substrate includes a plurality of gate lines 121 that are parallel to each other and that each extend along a first direction, and a plurality of data lines 122 that are parallel to each other and that each extend along a second direction orthogonal to the first direction. The gate lines 121 cross the data lines 122, thereby define a plurality of pixel units 130 (only one shown).

In each pixel unit, a thin film transistor (TFT) 123 is provided in the vicinity of a respective point of intersection of one of the gate lines 121 and one of the data lines 122. The TFT 123 functions as a switching element. A liquid crystal capacitor 127 and a storage capacitor 128 connected in parallel are also provided.

The TFT 123 includes a gate electrode 1231, a source electrode 1232, and a drain electrode 1233. The gate electrode 1231 is connected to a corresponding gate line 121. The source electrode 1232 is connected to a corresponding data line 122. The drain electrode 1233 is connected to the liquid crystal capacitor 127 and the storage capacitor 128.

The liquid crystal capacitor 127 includes a pixel electrode 124, a corresponding common electrode 125 and liquid crystal molecules of the liquid crystal layer sandwiched between the two electrodes 124, 125. The pixel electrode 124 is formed on the first substrate and is connected to the drain electrode 1233 of the TFT 123. The corresponding common electrode 125 is formed on the second substrate.

When the active matrix LCD 100 works, an electric field between the pixel electrode 124 and the common electrode 125 is applied to the liquid crystal molecules of the liquid crystal layer. Light from a light source such as a backlight passes through the second substrate, the liquid crystal layer, and the first substrate. The amount of the light penetrating the substrates is adjusted by controlling the strength of the electric field, in order to obtain a desired optical output for the pixel unit 130.

If an electric field between the pixel electrode 124 and the common electrode 125 continues to be applied to the liquid crystal material in one direction, the liquid crystal material may deteriorate. Therefore, in order to avoid this problem, pixel voltages that are provided to the pixel electrode 124 are switched from a positive value to a negative value with respect to a common voltage of the common electrode 125. This technique is referred to as an inversion drive method.

FIG. 9 is a timing chart illustrating operation of the active matrix LCD 100. In the chart, a Cartesian x-axis (not shown) represents time, and a Cartesian y-axis (not shown) represents voltage. $V1_g$ represents a plurality of scanning signals provided by the gate driver 111. $V1_s$ represents a plurality of gradation voltages provided by the data driver 112. $V1_d$ represents a plurality of pixel voltages of the pixel electrode 124. $\Delta V_g$ represents an impulse width of each scanning signal $V_g$, and is equal to a difference between a gate-on signal $V_{on}$ and a gate-off signal $V_{off}$. $V1_{com}$ represents a common voltage of the common electrode 125 provided by an external circuit (not shown). $\Delta V$ represents a voltage distortion related to the pixel voltage $V1_d$.

When a gate-on voltage $V_{on}$ is provided to the gate electrode 1231 of the TFT 123 via the gate line 121, the TFT 123 connected to the gate line 121 turns on. At the same time, a gradation voltage $V1_s$ generated by the data driver 112 is provided to the pixel electrode 124 via the data line 122 and the activated TFT 123 in series. The potentials of the common electrodes 125 are set at a uniform potential $V1_{com}$. Accordingly, the liquid crystal capacitor 127 and the storage capacitor 128 connected in parallel are charged to obtain a voltage difference between the gradation voltage $V1_s$ and the common voltage $V1_{com}$. Therefore, an electric field is generated due to the voltage difference between the pixel electrode 124 and the common electrode 125. The electric field is used to control the amount of light transmission of the corresponding pixel unit 130.

When a gate-off voltage $V1_{off}$ is provided to the gate electrode 1231 of the TFT 123 via the gate line 121, the TFT 123 turns off. The gradation voltage $V1_s$ applied to the liquid crystal capacitor 127 while the TFT 123 is turned on should be maintained as the pixel voltage $V1_d$ by the liquid crystal capacitor 127 and the storage capacitor 128 after the TFT 123 turns off. However, due to a parasitic capacitance $C_{gd}$ (not shown) between the gate electrode 1231 and the drain electrode 1233 of the TFT 123, the pixel voltage $V1_d$ of the pixel electrode 124 is distorted when the TFT 123 turns off. This kind of voltage distortion $\Delta V$ is known as a kick-back voltage, and the kick-back voltage is obtained by following formula:

$$\Delta V = \frac{C_{gd}}{C_{gd} + C_{lc}} \times \Delta V_g \tag{1}$$

The voltage distortion $\Delta V$ always tends to reduce the pixel voltage $V_d$ regardless of the polarity of the data voltage, as shown in FIG. 9.

The pixel voltage $V1_d$ of the pixel electrode 124 after the TFT 123 turns off is less than the gradation voltage $V1_s$ applied to the pixel electrode 124 before the TFT 123 turns off. Accordingly, the electric field used to control the amount of light transmission of the corresponding pixel unit 130 is decreased when the TFT 123 turns off. Therefore, a light transmission of the corresponding pixel unit 130 when the TFT 123 turns on is greater than a light transmission of the corresponding pixel unit 130 when the TFT 123 turns off. As a result, the so-called flicker phenomena appears on a display screen of the active matrix LCD 100.

What is needed, therefore, is an active matrix LCD that can overcome the above-described problems. What is also needed is a related method for driving such kind of active matrix LCD.

SUMMARY

In one preferred embodiment, an active matrix LCD includes an LCD panel, a gate driver, a data driver, and a voltage compensating circuit. The LCD panel includes a plurality of gate lines that are parallel to each other and that each extend along a first direction, and a plurality of data lines that are parallel to each other and that each extend along a second direction orthogonal to the first direction. The gate lines cross the data lines, thereby defining a plurality of pixel units. Each pixel unit includes a liquid crystal capacitor and a TFT provided in the vicinity of a respective point of intersection of one of the gate lines and one of the data lines. The liquid crystal capacitor includes a pixel electrode, and a common electrode. The gate driver is connected to the gate lines. The data driver is connected to the data lines. The voltage compensating circuit is configured for detecting a first voltage of a source electrode of one of the TFTs when the TFT turns on, detecting a second voltage of a drain electrode of the TFT when the TFT turns off, and then outputting a compensating voltage according to the first voltage and the second voltage for compensating a kick-back voltage of the TFT.

Other advantages and novel features will become more apparent from the following detailed description when taken in conjunction with the accompanying drawings.

DETAILED DESCRIPTION OF PREFERRED EMBODIMENTS

Figure 1:
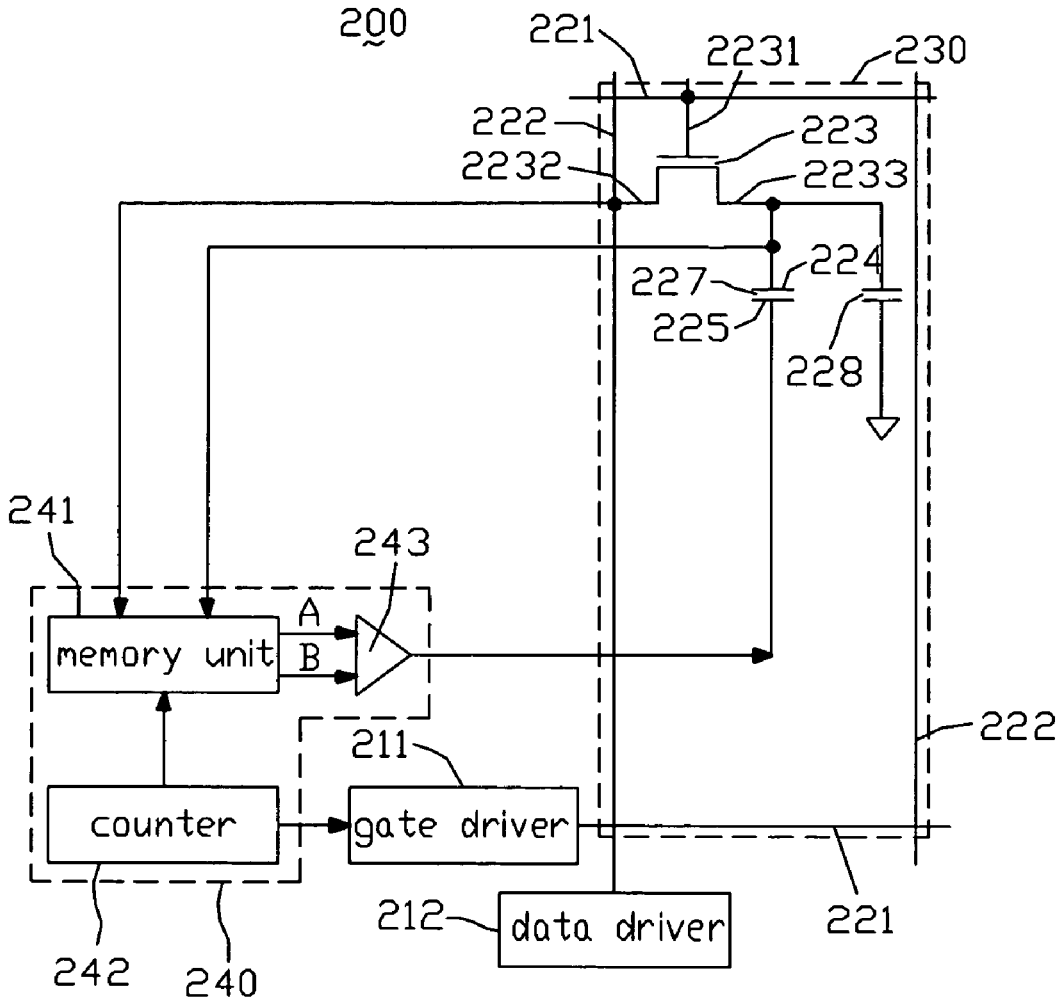
FIG. 1 is a circuit diagram of one pixel unit, a voltage compensating circuit, a gate driver, and a data driver of an active matrix LCD according to a first embodiment of the present invention.

FIG. 1 is a circuit diagram of one pixel unit, a voltage compensating circuit, a gate driver, and a data driver of an active matrix LCD 200 according to a first embodiment of the present invention. The active matrix LCD 200 includes an LCD panel (not shown), the voltage compensating circuit 240, the data driver 212, and the gate driver 211. The LCD panel includes a first substrate (not shown), a second substrate (not shown) arranged in a position facing the first substrate, and a liquid crystal layer (not shown) sandwiched between the first substrate and the second substrate. The active matrix LCD 200 is driven by an inversion drive method.

The first substrate includes a plurality of gate lines 221 that are parallel to each other and that each extend along a first direction, and a plurality of data lines 222 that are parallel to each other and that each extend along a second direction orthogonal to the first direction. The gate lines 221 cross the data lines 222, thereby defining a plurality of pixel units 230 (only one is shown).

In each pixel unit 230, a TFT 223 is provided in the vicinity of a respective point of intersection of one of the gate lines 221 and one of the data lines 222. The TFT 223 functions as a switching element. A liquid crystal capacitor 227 and a storage capacitor 228 connected in parallel are also provided.

The TFT 223 includes a gate electrode 2231, a source electrode 2232, and a drain electrode 2233. The gate electrode 2231 is connected to a corresponding gate line 221. The source electrode 2232 is connected to a corresponding data line 222. The drain electrode 2233 is connected to the liquid crystal capacitor 227 and the storage capacitor 228.

The liquid crystal capacitor 227 includes a pixel electrode 224, a corresponding common electrode 225, and liquid crystal molecules of the liquid crystal layer sandwiched between the two electrodes 224, 225. The pixel electrode 224 is formed on the first substrate and is connected to the drain electrode 2233 of the TFT 223. The corresponding common electrode 225 is formed on the second substrate.

The gate driver 211 is connected to the gate lines 221 for scanning the gate lines 221. The data driver 212 is connected to the data lines 222 for providing gradation voltages to the data lines 222.

The voltage compensating circuit 240 includes a memory unit 241, a counter 242, and a comparator 243. The memory unit 241 includes a pair of input terminals (not labeled) respectively connected to the source electrode 2232 and the drain electrode 2233 of one of the TFT 223, a controlling terminal (not labeled) and a pair of output terminals (not labeled). The counter 242 includes a first controlling terminal (not labeled) connected to the controlling terminal of the memory unit 241, and a second controlling terminal (not labeled) connected to the gate driver 211. The comparator 243 includes a pair of input terminal (not labeled) respectively connected to the pair of output terminals of the memory unit 241, and an output terminal (not labeled) connected to the common electrode 225.

The memory unit 241 is configured for storing two voltages respectively received from the source electrode 2232 and the drain electrode 2233 of the TFT 223. The counter 242 is configured for controlling operation of the memory unit 241. The comparator 243 is configured for receiving voltages from the pair of output terminals of the memory unit 241, and outputting a compensating voltage to the common electrode 225.

Figure 2:
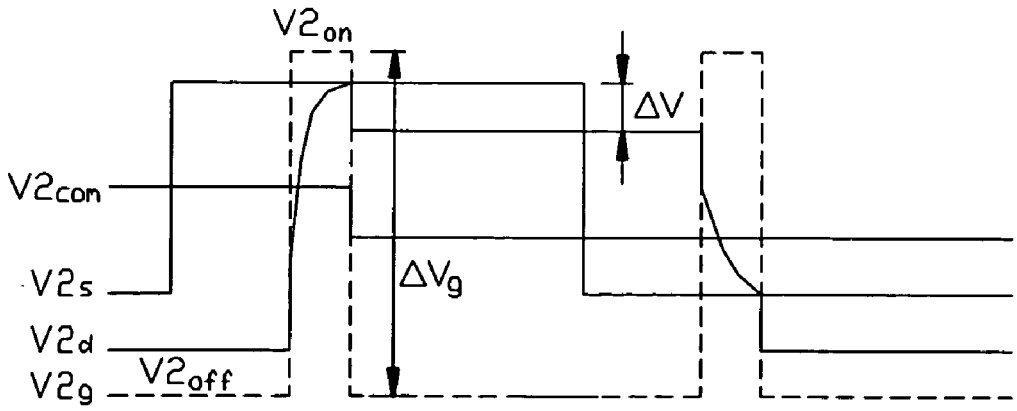
FIG. 2 is a timing chart illustrating operation of the active matrix LCD of FIG. 1.

FIG. 2 is a timing chart illustrating operation of the active matrix LCD 200. In the chart, a Cartesian x-axis (not shown) represents time, and a Cartesian y-axis shown) represents voltage. $V2_g$ represents a plurality of scanning signals provided by the gate driver 211. $V2_s$ represents a plurality of gradation voltages provided by the data driver 212. $V2_d$ represents a plurality of pixel voltages of the pixel electrode 224. $\Delta V_g$ represents an impulse width of each scanning signal $V2_g$, and is equal to a difference between a gate-on signal $V2_{on}$ and a gate-off signal $V2_{off}$. $V2_{com}$ represents a common voltage of the common electrode 225 provided by an external circuit (not shown). ΔV represents a kick-back voltage related to the pixel voltage $V2_d$. Because of the kick-back voltage ΔV generated when the TFT 223 turns off, the pixel voltage $V2_d$ of the pixel electrode 224 after the TFT 223 turns off is less than the gradation voltage $V2_s$ provided to the source electrode 2232 before the TFT 223 turns off.

Figure 3:
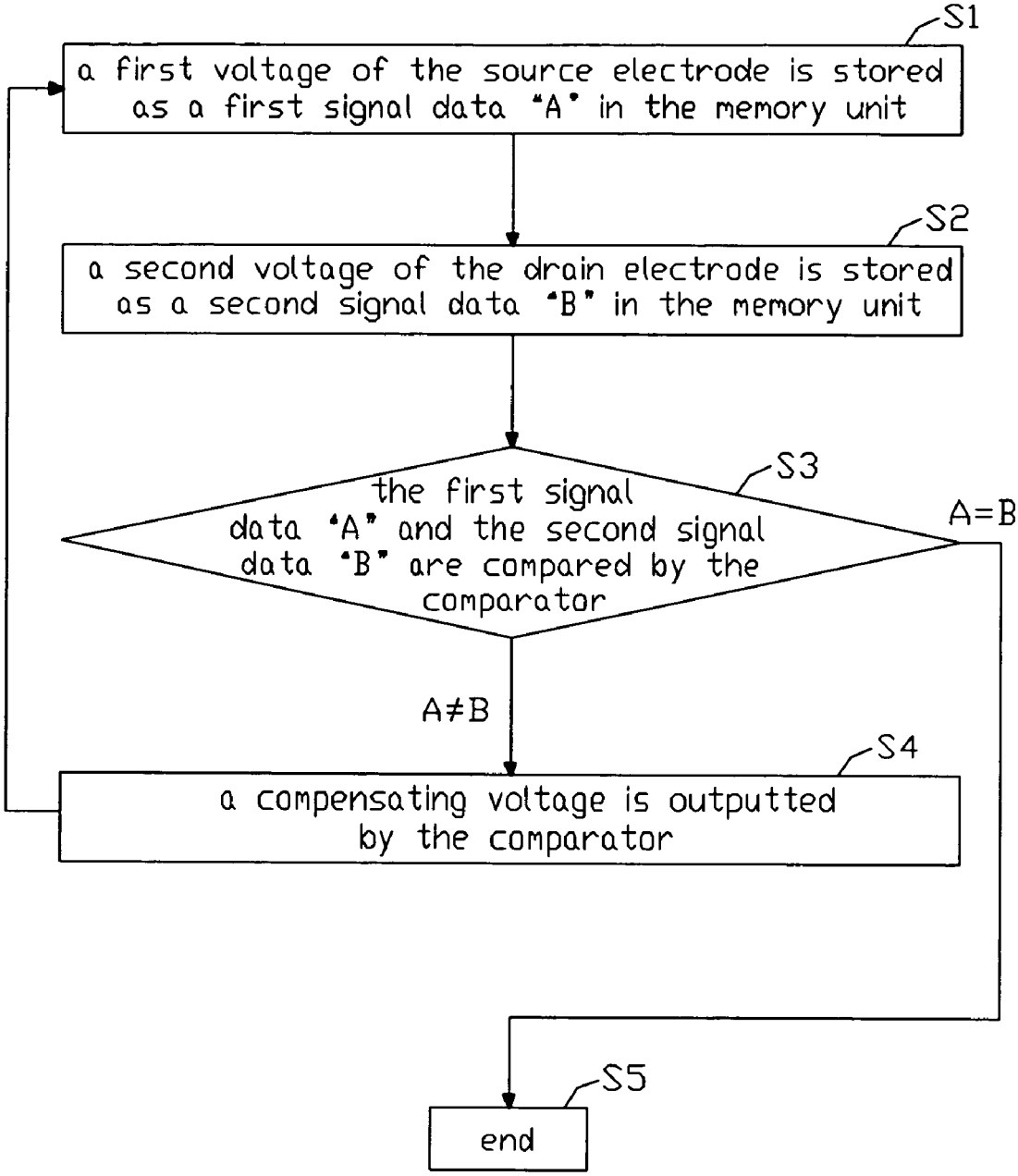
FIG. 3 is a flow chart of an exemplary method for driving the active matrix LCD of FIG. 1.

FIG. 3 is a flow chart of a driving method for compensating the kick-back voltage of the active matrix LCD 200. The driving method includes the following steps:

In step S1, a first voltage of the source electrode 2232 is stored as a first signal data "A" in the memory unit 241. At the beginning of a frame, when a gate-on signal $V2_{on}$ is provided to the TFT 223 and the TFT 223 turns on, the counter 242 controls the memory unit 241 to record or store a first voltage of the source electrode 2232 of the TFT 223 as the first signal data "A".

In step S2, a second voltage of the drain electrode 2233 is stored as a second signal data "B" in the memory unit 241. When a gate-off signal $V2_{off}$ is provided to the TFT 223 and the TFT 223 turns off, the counter 242 controls the memory unit 241 to record or store a second voltage of the drain electrode 2233 of the TFT 223 as the second signal data "B".

In step S3, the first signal data "A" and the second signal data "B" are compared by the comparator 243. The memory unit 241 provides the first signal data "A" and the second signal data "B" to the pair of input terminals of the comparator 243 respectively. The comparator 243 compares the first signal data "A" and the second signal data "B". If the first signal data "A" is different from the second signal data "B", step S4 (see below) is performed and then the steps S1-S3 are repeated. Otherwise, step S5 (see below) is performed.

In step S4, a compensating voltage is outputted by the comparator 243. The comparator 243 provides the compensating voltage to the common electrode 225 of the active matrix LCD 200.

In step S5, the comparator 243 remains idle through to the end of the frame.

When the comparator 243 provides the compensating voltage to the common electrode 225 of the active matrix LCD 200, the common voltage $V2_{com}$ of the common electrode 225 can be reduced to a lower voltage level as shown in FIG. 2. Thus when the TFT 223 turns off, the voltage difference between the pixel electrode 224 (or drain electrode 2233 of the TFT 223) and the common electrode 225 can reach a desired value which is equal to a voltage difference between a gradation voltage applied to the pixel electrode 224 and the common electrode 225 before the TFT 223 turns off.

In summary, the active matrix LCD 200 includes the voltage compensating circuit 240 which is configured for detecting the first voltage of the source electrode 2232 of the corresponding TFT 223 which turns on, detecting the second voltage of the drain electrode 2233 of the TFT 232 which turns off, and then providing the compensating voltage to the corresponding common electrode 225. Therefore the kick-back voltage of the pixel electrode 224 connected to the drain electrode 2233 can be compensated. Accordingly, an amount of light transmission of the pixel unit 230 when the TFT 223 turns on is equal to an amount of light transmission of the pixel unit 230 when the TFT 223 turns off. Thus, any flicker phenomena can be depressed or even eliminated from the LCD panel of the active matrix LCD 200.

Figure 4:
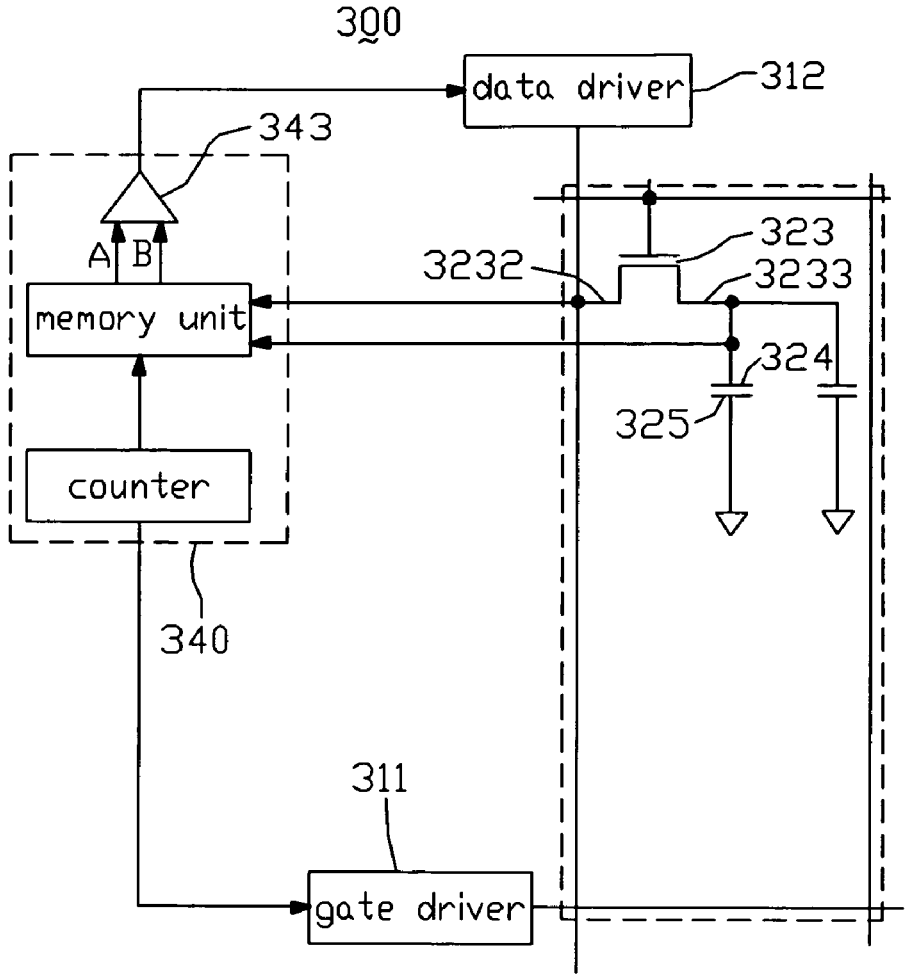
FIG. 4 is a circuit diagram of one pixel unit, a voltage compensating circuit, a data driver, and a gate driver of an active matrix LCD according to a second embodiment of the present invention.

FIG. 4 is a circuit diagram of one pixel unit, a voltage compensating circuit, a data driver, and a gate driver of an active matrix LCD according 300 to a second embodiment of the present invention. The active matrix LCD 300 is similar to the active matrix LCD 200 of the first embodiment. One difference is that in the active matrix LCD according 300, an output terminal (not labeled) of a comparator 343 of a voltage compensating circuit 340 is connected to a data driver 312. The comparator 343 provides a compensating voltage to the data driver 312.

Figure 5:
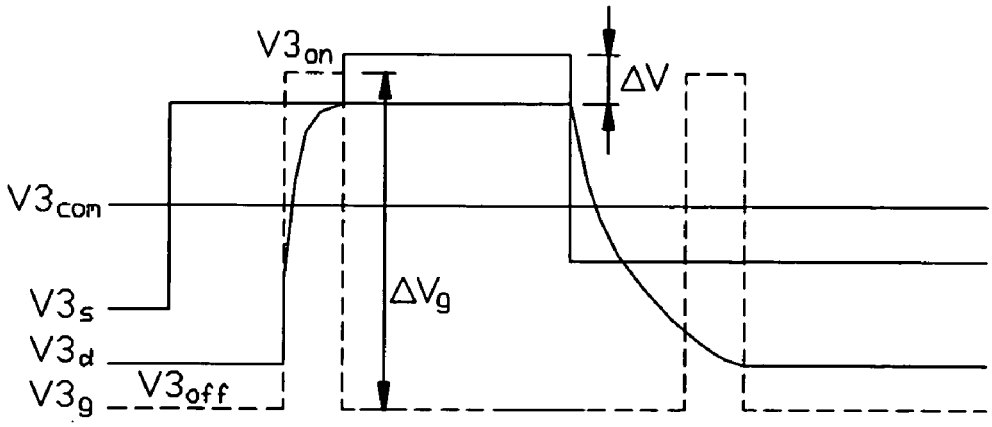
FIG. 5 is a timing chart illustrating operation of the active matrix LCD of FIG. 4.

Referring also to FIG. 5, this is a timing chart illustrating operation of the active matrix LCD 300. In the chart, a Cartesian x-axis (not shown) represents time, and a Cartesian y-axis (not shown) represents voltage. $V3_g$ represents a plurality of scanning signals provided by a gate driver 311. $V3_s$ represents a plurality of gradation voltages provided by the data driver 312. $V3_d$ represents a plurality of pixel voltages of a pixel electrode 324. $\Delta V_g$ represents an impulse width of each scanning signal $V3_g$, and is equal to a difference between a gate-on signal $V3_{on}$, and a gate-off signal $V3_{off}$. $V3_{com}$ represents a common voltage of the common electrode 325 provided by an external circuit (not shown).

Operation of the active matrix LCD 300 is similar to the operation of the active matrix LCD 200. One difference is that the comparator 343 provides a compensating voltage to the data driver 312 of the active matrix LCD 300 in order to increase a voltage of a drain electrode 3233 to a higher voltage level. When the TFT 323 turns off, the voltage of the drain electrode 3233 can be decreased by a kick-back voltage and reach a desired value. Therefore, an amount of light transmission of a corresponding pixel unit when the TFT 323 turns on is equal to an amount of light transmission of the pixel unit when the TFT 323 turns off. Thus, any flicker phenomena can be depressed or even eliminated from an LCD panel of the active matrix LCD 300.

Figure 6:
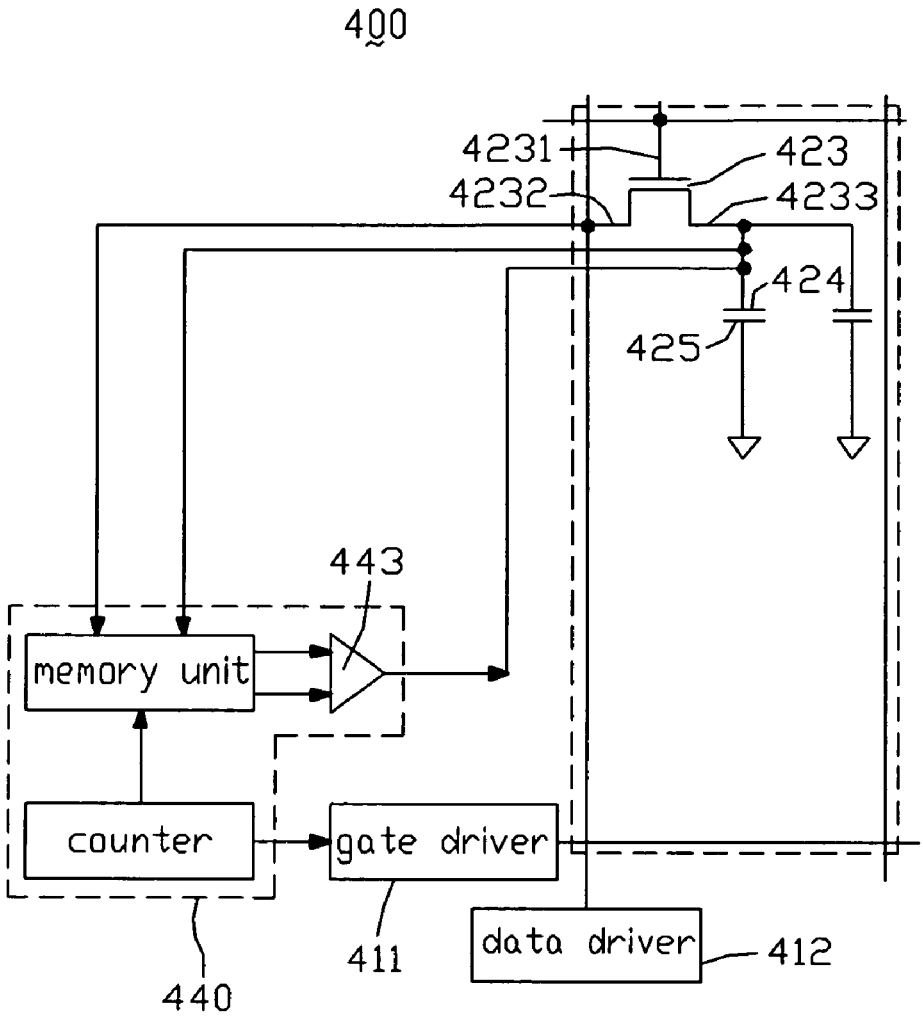
FIG. 6 is a circuit diagram of one pixel unit, a voltage compensating circuit, a gate driver, and a data driver of an active matrix LCD according to a third embodiment of the present invention.

FIG. 6 is a circuit diagram of one pixel unit, a voltage compensating circuit, a gate driver, and a data driver of an active matrix LCD 400 according to a third embodiment of the present invention. The active matrix LCD 400 is similar to the active matrix LCD 200 of the first embodiment. One difference is that in the active matrix LCD 400, an output terminal (not labeled) of a comparator 443 of a voltage compensating circuit 440 is connected to a drain electrode 4233 of a TFT 423. The comparator 443 provides a compensating voltage to the drain electrode 4233 of the TFT 423.

Figure 7:
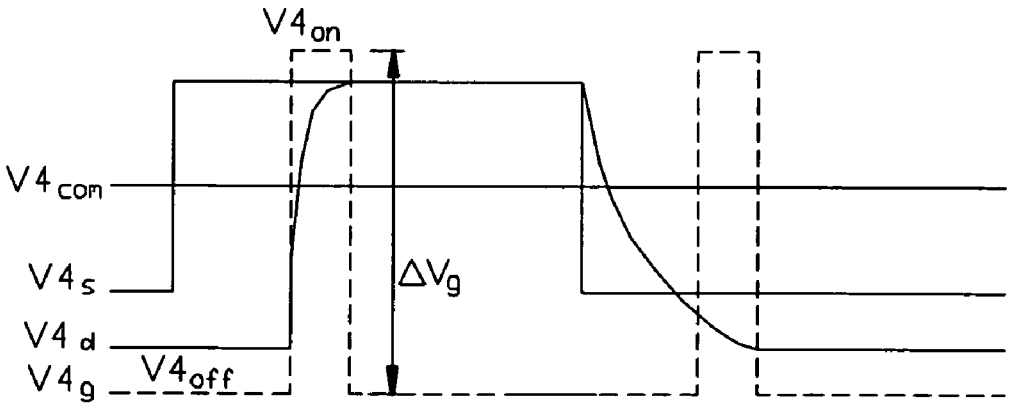
FIG. 7 is a timing chart illustrating operation of the active matrix LCD of FIG. 6.
Figure 8:
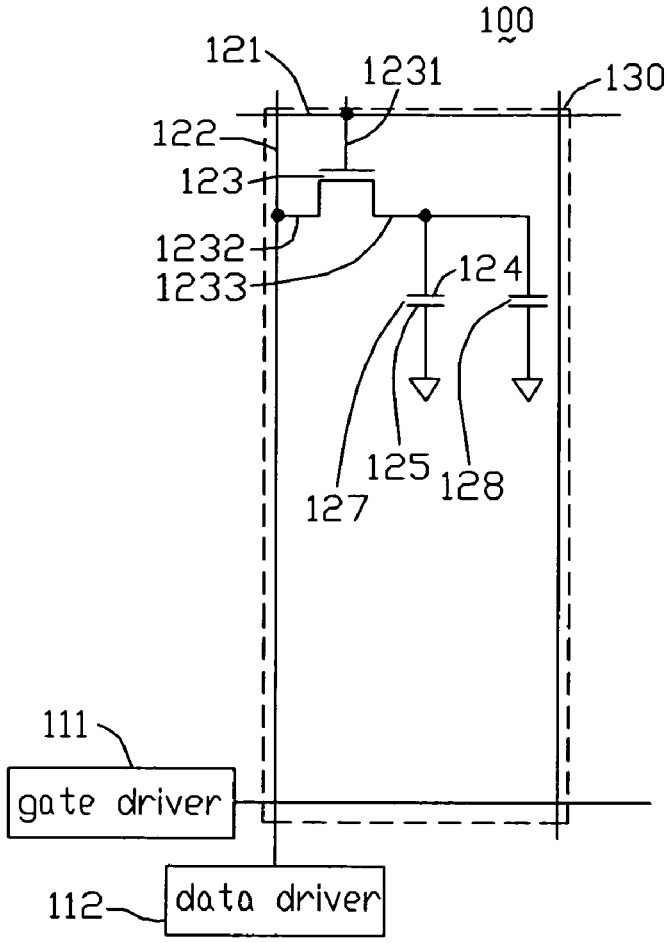
FIG. 8 (RELATED ART)
FIG. 8 is a circuit diagram of one pixel unit of a conventional active matrix LCD, also showing a gate driver and a data driver of the active matrix LCD.
Figure 9:
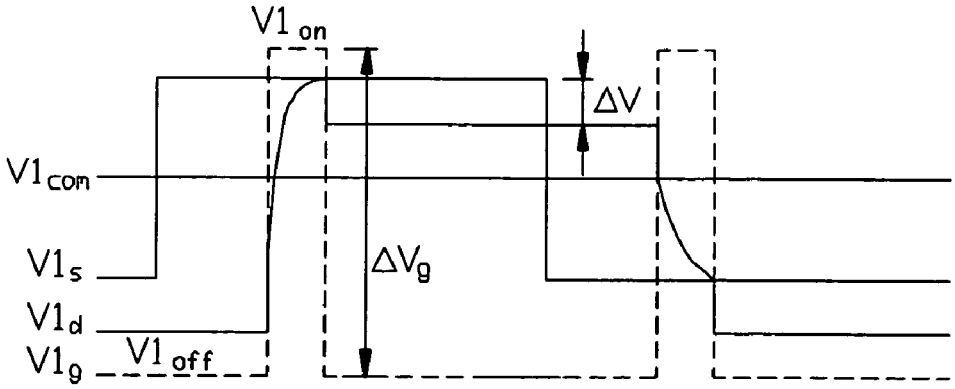
FIG. 9 (RELATED ART)
FIG. 9 is a timing chart illustrating operation of the active matrix LCD of FIG. 8.

Referring also to FIG. 7, this is a timing chart illustrating operation of the active matrix LCD 400. In the chart, a Cartesian x-axis (not shown) represents time, and a Cartesian y-axis (not shown) represents voltage. $V4_g$ represents a plurality of scanning signals provided by a gate driver 411. $V4_s$ represents a plurality of gradation voltages provided by the data driver 412. $V4_g$ represents a plurality of pixel voltages of a pixel electrode 424. $V4_{com}$ represents a common voltage of the common electrode 425 provided by an external circuit (not shown).

Operation of the active matrix LCD 400 is similar to the operation of the active matrix LCD 200. One difference is that the comparator 343 provides a compensating voltage to the drain electrode 4233 of the TFT 423 in order to compensate the kick-back voltage and prevent the voltage of the drain electrode 4233 from being decreased by the kick-back voltage. Therefore, an amount of light transmission of a corresponding pixel unit when the TFT 423 turns on is equal to an amount of light transmission of the pixel unit when the TFT 423 turns off. Thus, any flicker phenomena can be depressed or even eliminated from an LCD panel of the active matrix LCD 400.

Further or alternative embodiments may include the following. In one example, the comparator 343 provides a compensating voltage to a source electrode 3232 of a TFT 323 of the active matrix LCD 300. In further example, the memory unit 241 includes a plurality of pairs of input terminals. Each pair of terminals are respectively connected to the source electrode 2232 and the drain electrode 2233 of a respective one of the TFTs 223. When the TFTs 223 turn on, the counter 242 controls the memory unit 241 to record or store an average voltage of the source electrodes 2232 connected to the input terminals of the memory unit 241 as a first signal data. When the TFTs 223 turn off, the counter 242 controls the memory unit 241 to record or store an average voltage of the drain electrodes 2233 as a second signal data.

It is to be understood, however, that even though numerous characteristics and advantages of the present embodiments have been set out in the foregoing description, together with details of the structures and functions of the embodiments, the disclosure is illustrative only, and changes may be made in detail, especially in matters of size, and arrangement of parts within the principles of the invention to the full extent indicated by the broad general meaning of the terms in which the appended claims are expressed.

What is claimed is:

1. An active matrix liquid crystal display (LCD) comprising:

an LCD panel comprising: a plurality of gate lines that are parallel to each other and that each extend along a first direction; and a plurality of data lines that are parallel to each other and that each extend along a second direction orthogonal to the first direction; wherein the gate lines cross the data lines, thereby defining a plurality of pixel units, each pixel unit comprising: a liquid crystal capacitor comprising a pixel electrode and a common electrode; a thin film transistor (TFT) provided in the vicinity of a respective point of intersection of one of the gate lines and one of the data lines; and a storage capacitor connected in parallel with the liquid crystal capacitor;

a gate driver connected to the gate lines;

a data driver connected to the data lines; and a voltage compensating circuit including a memory circuit connected to the TFT, a comparator connected to the memory circuit, and a counter connected to the memory circuit and the gate driver; the counter controlling the memory circuit to detect a first voltage of a source electrode of one of the TFTs and store the first voltage of the source electrode of the TFT as a first signal data when the TFT turns on, and to detect a second voltage of a drain electrode of the TFT and store the second voltage of the source electrode of the TFT as a second signal data when the TFT turns off, the comparator comparing the first signal data and the second signal data, and then outputting a compensating voltage for compensating a kick-back voltage of the TFT if the first signal data is different from the second signal data.

2. The active matrix LCD as claimed in claim 1, wherein the memory unit comprises a pair of input terminals respectively connected to the source electrode and the drain electrode of the TFT, a controlling terminal, and a pair of output terminals;

the comparator comprises a pair of input terminals respectively connected to the pair of output terminals of the memory unit, and an output terminal configured for providing the compensating voltage; and the counter comprises a first controlling terminal connected to the controlling terminal of the memory unit, and a second controlling terminal connected to the gate driver;

wherein the memory unit provides the first signal data and the second signal data respectively to the pair of input terminals of the comparator, and the comparator outputs the compensating voltage from the output terminal if the first signal data is different from the second signal data.

3. The active matrix LCD as claimed in claim 2, wherein the output terminal of the voltage compensating circuit is connected to the data driver for providing the compensating voltage to the data driver.

4. The active matrix LCD as claimed in claim 2, wherein the output terminal of the voltage compensating circuit is connected to the source electrode of the TFT for providing the compensating voltage to the source electrode of the TFT.

5. The active matrix LCD as claimed in claim 2, wherein the output terminal of the voltage compensating circuit is connected to the drain electrode of the TFT for providing the compensating voltage to the drain electrode of the TFT.

6. The active matrix LCD as claimed in claim 2, wherein the output terminal of the voltage compensating circuit is connected to one of the common electrodes corresponding to the TFT for providing the compensating voltage to the common electrode.

7. A method for driving an active matrix liquid crystal display (LCD), wherein the active matrix LCD comprises an LCD panel, a gate driver connected to the LCD panel, a data driver connected to the LCD panel, and a voltage compensating circuit, the LCD panel comprises a plurality of pixel units, each pixel unit comprises a pixel electrode, a common electrode, and a thin film transistor (TFT), and the TFT comprises a drain electrode connected to the pixel electrode, a gate electrode, and a source electrode, the driving method comprising:

the voltage compensating circuit detecting a first voltage of the source electrode of one of the TFTs when the TFT turns on;

storing the first voltage of the source electrode of the TFT as a first signal data;

the voltage compensating circuit detecting a second voltage of the drain electrode of the TFT when the TFT turns off;

storing the second voltage of the drain electrode of the TFT as a second signal data;

comparing the first signal data and the second signal data; and the voltage compensating circuit outputting a compensating voltage for compensating a kick-back voltage of the TFT if the first signal data is different from the second signal data.

8. The method as claimed in claim 7, wherein the voltage compensating circuit comprises:

a memory unit comprising a pair of input terminals respectively connected to the source electrode and the drain electrode of the TFT, a controlling terminal, and a pair of output terminals;

a comparator comprising a pair of input terminals respectively connected to the pair of output terminals of the memory unit, and an output terminal for providing the compensating voltage; and a counter comprising a first controlling terminal connected to the controlling terminal of the memory unit, and a second controlling terminal connected to the gate driver; and the driving method further comprises:

the counter controlling the memory unit to store the first voltage of the source electrode of the TFT as a first signal data when the TFT turns on;

the counter controlling the memory unit to store the second voltage of the drain electrode of the TFT as a second signal data when the TFT turns off;

the memory unit providing the first signal data and the second signal data respectively to the pair of input terminals of the comparator; and the comparator comparing the first signal data and the second signal data, and outputting the compensating voltage from the output terminal thereof if the first signal data is different from the second signal data.

9. The method as claimed in claim 8, wherein the compensating voltage is provided to the data driver.

10. The method as claimed in claim 8, wherein the compensating voltage is provided to the source electrode of the TFT.

11. The method as claimed in claim 8, wherein the compensating voltage is provided to the drain electrode of the TFT.

12. The method as claimed in claim 8, wherein the compensating voltage is provided to the corresponding common electrode.

13. The method as claimed in claim 8, wherein the memory unit further comprises a plurality of pairs of input terminals, each pair of terminals respectively being connected to the source electrode and the drain electrode of one of the TFTs; the voltage compensating circuit detecting an first average voltage of a plurality of source electrodes of the TFTs and the counter controlling the memory unit to store the first average voltage as a first signal data when the corresponding TFTs turn on, the voltage compensating circuit detecting a second average voltage of a plurality of drain electrodes of the TFTs and the counter controlling the memory unit to store the second average voltage as a second signal data when the corresponding TFTs turn off, then the memory unit providing the first signal data and the second signal data respectively to the pair of input terminals of the comparator, and the comparator outputting the compensating voltage from the output terminal if the first signal data is different from the second signal data, thereby compensating a kick-back voltage of the TFT.

14. An active matrix liquid crystal display (LCD) comprising:

an LCD panel comprising: a plurality of gate lines that are parallel to each other and that each extend along a first direction; and a plurality of data lines that are parallel to each other and that each extend along a second direction orthogonal to the first direction; wherein the gate lines cross the data lines, thereby defining a plurality of pixel units, each pixel unit comprising: a liquid crystal capacitor comprising a pixel electrode and a common electrode; and a thin film transistor (TFT) provided in the vicinity of a respective point of intersection of one of the gate lines and one of the data lines;

a gate driver connected to the gate lines;

a data driver connected to the data lines; and a voltage compensating circuit comprising: a memory unit comprising a plurality of pairs of input terminals, a controlling terminal, and a pair of output terminals, each pair of terminals respectively being connected to the source electrode and the drain electrode of one of the TFTs; a comparator comprising a pair of input terminals respectively connected to the pair of output terminals of the memory unit, and an output terminal configured for providing the compensating voltage; and a counter comprising a first controlling terminal connected to the controlling terminal of the memory unit, and a second controlling terminal connected to the gate driver; the voltage compensating circuit detecting an first average voltage of a plurality of source electrodes of the TFTs and the counter controlling the memory unit to store the first average voltage as a first signal data when the corresponding TFTs turn on, the voltage compensating circuit detecting a second average voltage of a plurality of drain electrodes of the TFTs and the counter controlling the memory unit to store the second average voltage as a second signal data when the corresponding TFTs turn off, then the memory unit providing the first signal data and the second signal data respectively to the pair of input terminals of the comparator, and the comparator outputting the compensating voltage from the output terminal if the first signal data is different from the second signal data, thereby compensating a kick-back voltage of the TFT.

15. The active matrix LCD as claimed in claim 14, wherein the output terminal of the voltage compensating circuit is connected to the data driver for providing the compensating voltage to the data driver.

16. The active matrix LCD as claimed in claim 14, wherein the output terminal of the voltage compensating circuit is connected to the source electrode of the TFT for providing the compensating voltage to the source electrode of the TFT.

17. The active matrix LCD as claimed in claim 14, wherein the output terminal of the voltage compensating circuit is connected to the drain electrode of the TFT for providing the compensating voltage to the drain electrode of the TFT.

18. The active matrix LCD as claimed in claim 14, wherein the output terminal of the voltage compensating circuit is connected to one of the common electrodes corresponding to the TFT for providing the compensating voltage to the common electrode.

19. The active matrix LCD as claimed in claim 14, wherein each pixel unit further comprises a storage capacitor connected in parallel with the liquid crystal capacitor.

* * * * *